US007251886B1

(12) United States Patent
Pekar et al.

(10) Patent No.: US 7,251,886 B1
(45) Date of Patent: Aug. 7, 2007

(54) SYSTEM FOR INSTALLING A CORD IN A CAVITY

(76) Inventors: Gary W. Pekar, 1515 Lloyds Hall Ct., Mansfield, TX (US) 76063; Terri L. Pekar, 1515 Lloyds Hall Ct., Mansfield, TX (US) 76063

( * ) Notice: Subject to any disclaimer, the term of this patent is extended or adjusted under 35 U.S.C. 154(b) by 120 days.

(21) Appl. No.: 11/191,832

(22) Filed: Jul. 28, 2005

Related U.S. Application Data

(60) Provisional application No. 60/592,325, filed on Jul. 28, 2004.

(51) Int. Cl.
*H01R 43/00* (2006.01)

(52) U.S. Cl. ..... 29/869; 29/825; 29/868

(58) Field of Classification Search ..... 29/825, 29/868, 869
See application file for complete search history.

(56) References Cited

U.S. PATENT DOCUMENTS 2,946,560 A 7/1960 Ferm
3,078,073 A 2/1963 Zizzo
3,971,543 A 7/1976 Shanahan
4,527,775 A 7/1985 Flowers
4,572,561 A 2/1986 Hale
4,618,124 A 10/1986 Flowers
5,522,630 A 6/1996 James
2003/0213943 A1 11/2003 Turner

*Primary Examiner*—Carl J. Arbes
(74) *Attorney, Agent, or Firm*—Eric Karich

(57) ABSTRACT

A system for installing a cord in a cavity includes a traveling member and a base assembly. The traveling member includes a first magnet member attached to a first leader for insertion in a first opening. The base assembly includes a magnetic bar, a second magnet member attached to a second leader, and an elongate probe member having an end adapted to removably receive the second magnet member. When the traveling member is positioned within the cavity, a magnetic attraction develops between the first magnet member and the magnetic bar, pulling the traveling member toward the base assembly for establishing a magnetic connection with the second magnet member.

13 Claims, 5 Drawing Sheets

SYSTEM FOR INSTALLING A CORD IN A CAVITY

CROSS-REFERENCE TO RELATED APPLICATIONS

This application for a utility patent claims the benefit of U.S. Provisional Application No. 60/592,325, filed Jul. 28, 2004.

STATEMENT REGARDING FEDERALLY SPONSORED RESEARCH

Not Applicable

BACKGROUND OF THE INVENTION

1. Field of the Invention

This invention relates generally to cord installation systems, and more particularly to systems for installing cords in cavities.

2. Description of Related Art

In general, a cord is a slender length of flexible material used to bind, tie, connect, or support. As defined herein, an electrical cable is a cord that includes one or more flexible electric wires or signal lines. Examples of common electrical cables include electrical power cables, communication cables, control cables, and speaker wires.

An electrical cable is typically installed in an existing hollow wall by routing the electrical cable through an interior cavity of the wall. A lower hole is typically cut in a lower portion of the wall, and an upper hole is cut in an upper portion of the wall. A pull string is inserted into the wall cavity via the upper hole such that an end of the pull string is positioned adjacent the lower hole. A hook at one end of a rod is typically used to retrieve the end of the pull string from the cavity via the lower hole. An end of the electrical cable is attached to the end of the pull string, and the electrical cable is installed in the wall cavity by retrieving the pull string via the upper opening.

While the above installation method can be accomplished relatively quickly and easily by two people, one positioned at the lower opening and the other positioned at the upper opening, it is very difficult for a single person working alone to carry out the above installation method. Accordingly, it would be beneficial to have a system for installing a cord in a wall cavity that would allow a single person working alone to install the cord relatively quickly and easily.

SUMMARY OF THE INVENTION

The present invention teaches certain benefits in construction and use which give rise to the objectives described below.

The present invention provides a system for installing a cord in a cavity, the system including a traveling member and a base assembly. The traveling member includes a first magnet member attached to a first leader for insertion in a first opening. The base assembly includes a magnetic bar, a second magnet member attached to a second leader, and an elongate probe member having an end adapted to removably receive the second magnet member. When the traveling member is positioned within the cavity, a magnetic attraction develops between the first magnet member and the magnetic bar, pulling the traveling member toward the base assembly for establishing a magnetic connection with the second magnet member.

A primary objective of the present invention is to provide a system for installing a cord in a wall cavity, the system having advantages not taught by the prior art.

Another objective is to provide a system that enables a cord to be installed by a single person rather than two persons, as is required by prior art systems.

A further objective is to provide a system that is fast and easy to use.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
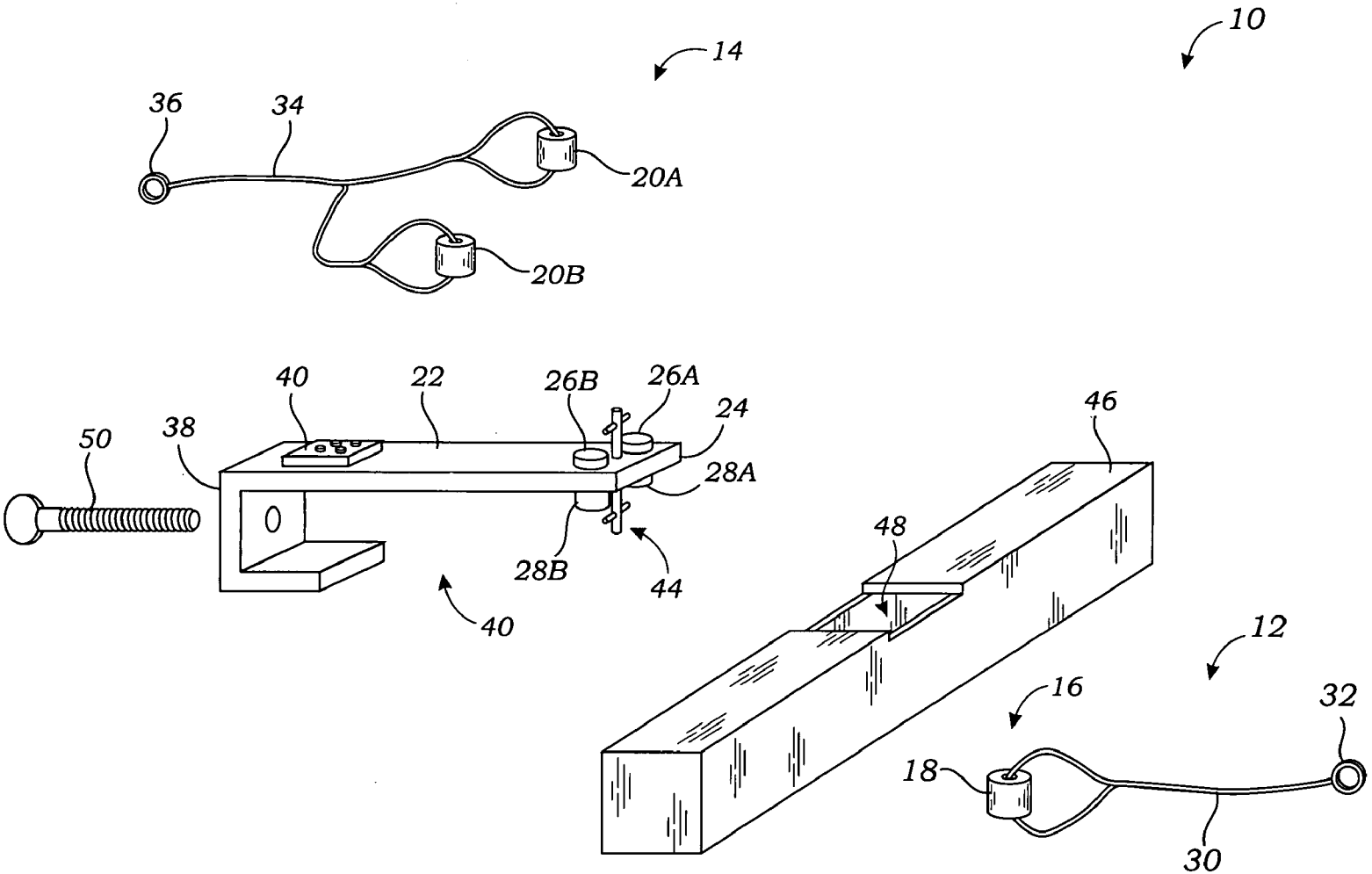
FIG. 1 is a perspective view of one embodiment of a system for installing a cord in a cavity of a wall, wherein the system includes a traveling member and a base assembly.

FIG. 1 is a perspective view of one embodiment of a system 10 for installing a cord in a cavity of a wall. The cord may be, for example, an electrical cable including one or more flexible electric wires or signal lines. The electrical cable may be, for example, an electrical power cable, a communication cable, a control cable, or speaker wire. The cord may also be any other similar elongate strand, regardless of the particular function of the strand. As will become clear, the system 10 allows a single person working alone to install the cord in the wall cavity relatively quickly and easily. While we discuss the case of installing the cord in a wall, this terminology should be construed, and is hereby specifically defined, to include alternative cavities, including installing cords through eaves, boats, conduits, or like cavities or hard to reach spaces.

In the embodiment of FIG. 1, the system 10 includes a traveling member 12 and a base assembly 14. In general, the traveling member 12 includes a rolling mechanism 16 and a magnet member 18. The traveling member 12 is adapted for attachment to an end of a first leader, and for insertion in a first opening in the wall.

The base assembly 14 includes a tether 34, an elongate probe member 22, and a magnetic bar 46. The tether 34 includes at least one and preferably two magnet members 20A and 20B. The tether 34 and the traveling member 12 are adapted to magnetically engage each other for pulling a leader strand through the wall, which can then be used to pull a cord through the wall, as described below.

The elongate probe member 22 and the magnetic bar 46 function to facilitate to connection of the tether 34 and the traveling member 12. In general, an end 24 of the probe member 22 is adapted to removably receive the magnet members 20A and 20B. More specifically, two receiving structures 26A and 26B are attached at opposite sides of an upper surface of the end 24 of the probe member 22. The receiving structure 26A is adapted to receive the magnet member 20A and to removably hold the magnet member 20A in place via magnetic attraction. Similarly, the receiving structure 26B is adapted to receive the magnet member 20B and to removably hold the magnet member 20B in place via magnetic attraction. The end 24 of the probe member 22, with the magnet members 20A and 20B removably positioned on the respective receiving structures 26A and 26B, is adapted for insertion in a second opening in the wall.

In the embodiment of FIG. 1, the receiving structures 26A and 26B are disk magnets. Another pair of disk magnets 28A and 28B positioned on a bottom surface of the end 24 of the probe member 22 directly opposite the respective receiving structures 26A and 26B magnetically hold the receiving structures 26A and 26B in place.

When the traveling member 12 is positioned near a surface and near the base assembly 14, a magnetic attraction develops between the magnet member 18 of the traveling member 12 and the magnetic bar 46 of the base assembly 14. In response to the magnetic attraction, the rolling mechanism 16 of the traveling member 12 allows the traveling member 12 to roll along the surface toward magnetic bar 46 and the base assembly 14.

The magnet member 18 of the traveling member 12 is preferably substantially cylindrical and is attached to a tether 30 of the traveling member 12 such that the magnet member 18 is free to rotate about an axis. More specifically, the magnet member 18 has a hollow center, and a portion of the tether 30 passes through the hollow center of the magnet member 18. As a result, the magnet member 18 forms a roller of the rolling mechanism 16. While the present embodiment is preferred, other rolling mechanisms are possible and contemplated and should be considered within the scope of the following claims.

In the embodiment of FIG. 1, the magnet members 20A and 20B of the base assembly 14 have hollow centers, and portions of a tether 34 of the base assembly 14 pass through the hollow centers of the magnet members 20A and 20B. The tether 30 of the traveling member 12 has an end attached to an eyelet 32, and the eyelet 32 is adapted for attachment to an end of a first leader. Similarly, the tether 34 of the base assembly 14 has an end attached to an eyelet 36, and the eyelet 36 is adapted for attachment to an end of a second leader. As described in more detail below, the first and second leaders are used to install the cord in the wall cavity.

In the embodiment of FIG. 1, the base assembly 14 includes a bracket 38 attached to the probe member 22. As described in more detail below, the bracket 38 is adapted for attaching the base assembly 14 to an edge of the second opening in the wall such that the probe member 22 remains positioned in the second opening.

As described above, when the traveling member 12 is positioned near a surface and near the base assembly 14, a magnetic attraction develops between the magnet member 18 of the traveling member 12 and the magnetic bar 46, and the rolling mechanism 16 of the traveling member 12 allows the traveling member 12 to roll along the surface toward the base assembly 14. Once the magnet member 18 is adjacent the probe member 22, it is attracted to and magnetically connects with one of the magnet members 20A and 20B of the base assembly 14.

In the embodiment of FIG. 1, the base assembly 14 includes an optional annunciator circuit 40 adapted to produce a sound when the traveling member 12 contacts the base assembly 14. The sound notifies a user of the system 10 that the traveling member 12 has contacted the base assembly 14. The annunciator circuit 40 preferably includes a sound producing circuit connected to a pair of electrical contacts (not shown). In general, the pair of electrical contacts are activated when the traveling member 12 contacts the base assembly 14, and the activated pair of electrical contacts cause the sound producing circuit to produce the sound. It is noted that the annunciator circuit 40, while highly advantageous, is not necessary for use of the system 10.

In the embodiment of FIG. 1, the probe member 22 is preferably made of a material that has magnetic properties resembling those of iron (e.g., a ferromagnetic material). The base assembly 14 includes a magnetic bar 46 which preferably includes a slot 48 in an upper surface. While we use the term magnetic bar, the term "bar" should be construed to limit the particular shape of the magnet, but should be construed to include any form or shape of magnet that is functional for the purposes of the described method.

The magnetic bar 46 is a powerful magnet that functions to attract the magnet member 18, as described above. The slot 48 is adapted to receive the probe member 22. When the probe member 22 is positioned in the slot 48, the probe member 22 is magnetically and removably attached to the magnetic bar 46, and can be moved transversely along the upper surface of the magnetic bar 46 within the slot 48. A thumbscrew 50 of the base assembly 14, threadedly received in the bracket 38, a standoff (see FIG. 2) attached to a bottom surface of the probe member 22, and the magnetic bar 46 may be used to attach the base assembly 14 to the edge of the second opening in the wall.

It is noted that while the system 10 of FIG. 1 includes two magnet members 20A and 20B, other embodiments of the system 10 may have a single magnet member.

Figure 2:
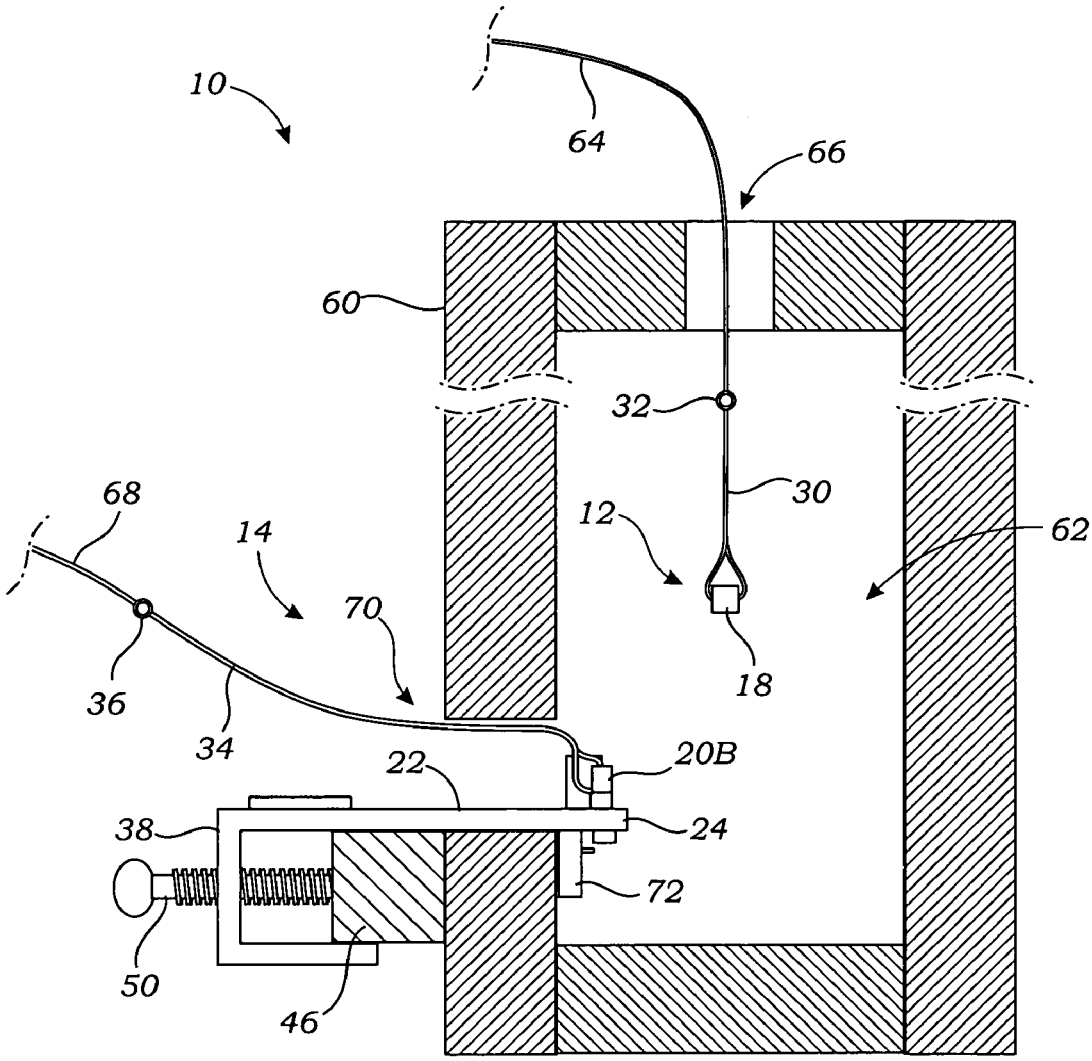
FIG. 2 is a cross sectional view of a hollow wall having an interior cavity, wherein the traveling member of the system of FIG. 1 has been inserted into the cavity via a first opening in the wall, and an end of a probe member of the base assembly has been inserted into the cavity via a second opening in the wall.

FIGS. 2-6 will now be used to describe a use of the system 10 of FIG. 1 to install a cord in a cavity of a hollow wall. FIG. 2 is a cross sectional view of a hollow wall 60 having an interior cavity 62, wherein the traveling member 12 of the system 10 of FIG. 1 has been inserted into the cavity 62 via a first opening 66 in the wall 60, and the end 24 of the probe member 22 of the base assembly 14 of the system 10 has been inserted into the cavity 62 via a second opening 70 in the wall 60. The first opening 66 and the second opening 70 allow access to the interior cavity 62 of the wall 60.

Figure 3:
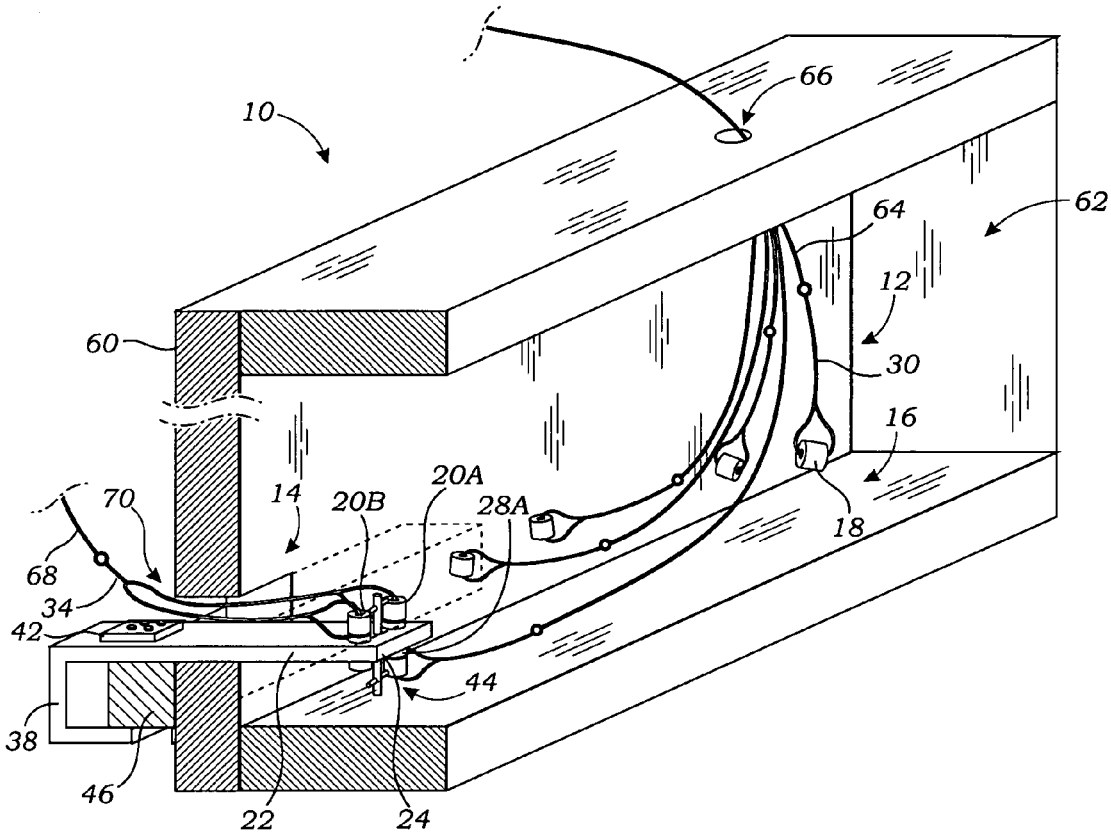
FIG. 3 is a cross sectional view of the wall of FIG. 2 illustrating movement of the traveling member toward the base assembly within the cavity in response to a magnetic attraction developed between the traveling member and the base assembly.

In FIG. 2, an end of a first leader 64 has been attached to the eyelet 32 of the tether 30 of the traveling member 12. The magnet members 20A and 20B of the base assembly 14 have been removably received on the end 24 of the probe member 22. One end of a second leader 68 has been attached to the eyelet 36 of the tether 34 of the base assembly 14. An end of the cord to be installed has preferably been attached to an opposite end of the second leader 68 at this point. The end 24 of the probe member 22, with the magnet members 20A and 20B removably positioned thereon, has been inserted into the cavity 62 of the wall 60 via the second opening 70. The thumbscrew 50, a standoff 72 of the base assembly 14 attached to the bottom surface of the probe member 22, and the magnetic bar 46 have been used to attach the base assembly 14 to a bottom edge of the second opening 70. An end of a cord (e.g., an electrical cable) is preferably attached to an end of the second leader 68 opposite the end attached to the eyelet 36 of the tether 34 of the base assembly 14 before the above process is carried out FIG. 3 is a cross sectional view of the wall 60 of FIG. 2 illustrating movement of the traveling member 12 toward the base assembly 14 within the cavity 62 in response to a magnetic attraction developed between the traveling member 12 and the magnet bar 46. In FIG. 3, the traveling member 12 has been positioned in the cavity 62 near the base assembly 14. In response to the magnetic attraction developed between the magnet member 18 of the traveling member 12 and the magnet bar 46, the rolling mechanism 16 of the traveling member 12 allows the traveling member 12 to roll along the side surface of the cavity 62, toward the base assembly 14. Finally, the traveling member 12 reaches the base assembly 14 and contacts the disk magnet 28A directly under the magnet member 20A. The pair of electrical contacts of the annunciator circuit 40 are activated, and the activated pair of electrical contacts cause the sound producing circuit to produce the sound notifying the user that the traveling member 12 has contacted the base assembly 14.

Figure 4:
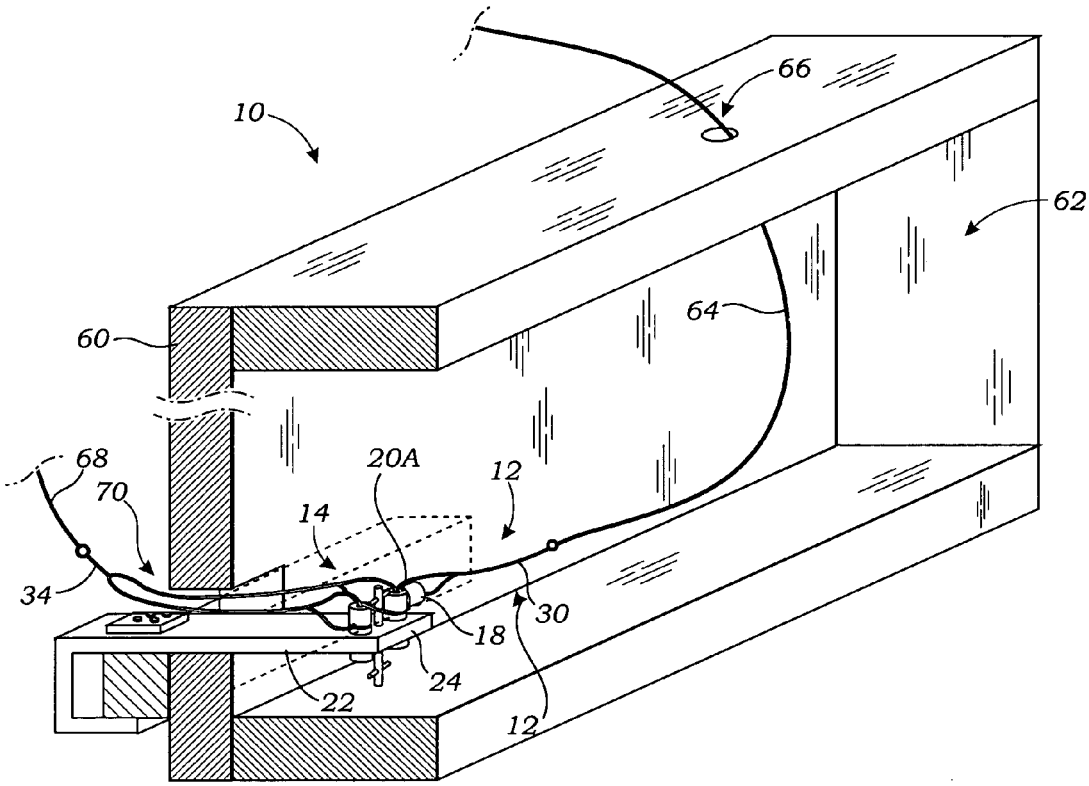
FIG. 4 is a cross sectional view of the wall of FIG. 3 as a first leader attached to the traveling member is pulled upwardly through the first opening in the wall.

FIG. 4 is a cross sectional view of the wall 60 of FIG. 3 as the first leader 64 attached to the traveling member 12 is pulled upwardly through the first opening 66 in the wall 60, causing the magnet member 18 of the traveling member 12 to move in the upward direction from the disk magnet 28A at the bottom surface of the end 24 of the probe member 22 of the base assembly 14 to the magnet member 20A at the upper surface of the end 24 of the probe member 22. As shown in FIG. 4, the traveling member 12 is magnetically attached to the magnet member 20A of the base assembly 14.

Figure 5:
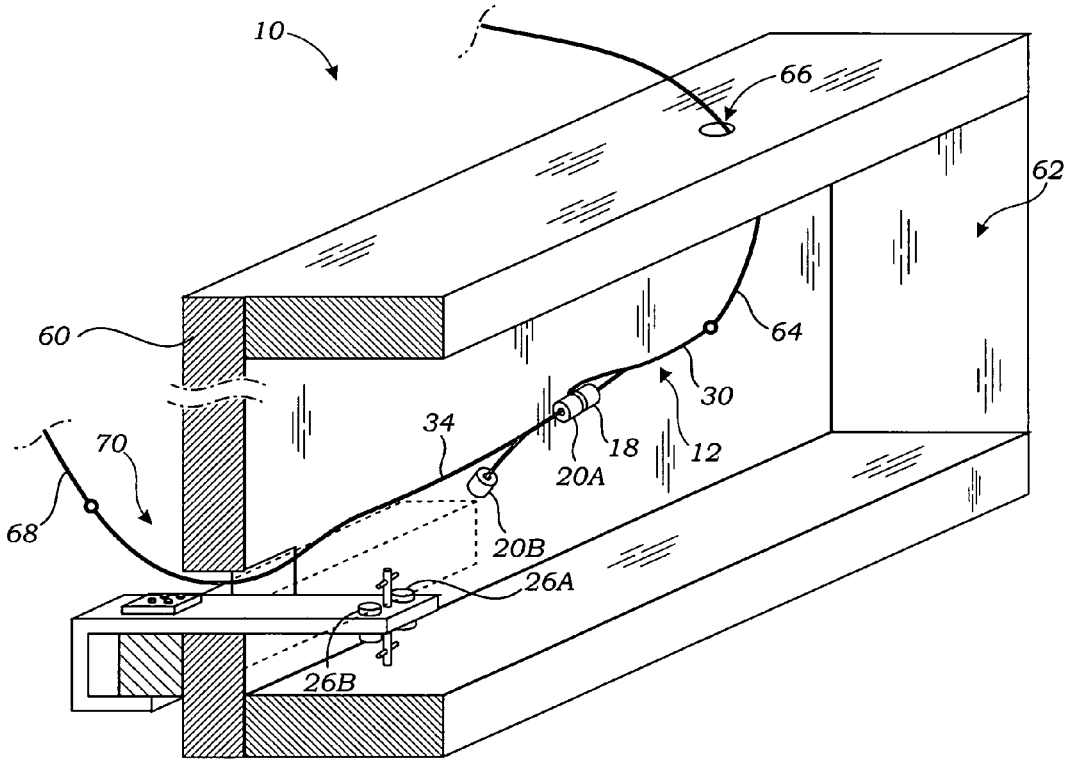
FIG. 5 is a cross sectional view of the wall of FIG. 4 as the first leader continues to be pulled upwardly through the first opening in the wall, causing a magnet member of the base assembly to be released from the base assembly, and a second leader attached to the magnet member to be drawn through the cavity.

FIG. 5 is a cross sectional view of the wall 60 of FIG. 4 as the first leader 64 attached to the traveling member 12 continues to be pulled upwardly through the first opening 66 in the wall 60, overcoming the magnetic attraction that holds the magnet member 20A to the receiving structure 26A and the magnet member 20B to the receiving structure 26B. As shown in FIG. 5, the traveling member 12 remains magnetically attached to the magnet member 20A of the base assembly 14, allowing the second leader 68 to be drawn through the cavity 62 of the wall 60 as the first leader 64 is retracted through the first opening 66 in the wall 60.

A length of the second leader 68 is greater than a distance between the first opening 66 and the second opening 70. It is noted that the end of the cord can be attached to the to the end of the second leader 68 at any time during the process. After the end of the cord is attached to the end of the second leader 68, retracting the second leader 68 through the cavity 62 of the wall 60 via the first opening 66 causes the cord to be drawn through the cavity 62.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A system for installing a cord in a cavity of having a surface, a first opening, and a second opening, the system comprising:

a traveling member having a first magnet member, wherein the traveling member is adapted for attachment to an end of a first leader and for insertion in the first opening of the cavity;

a base assembly comprising a magnetic bar, a second magnet member, and an elongate probe member having an end adapted to removably receive the second magnet member, wherein the second magnet member is adapted for attachment to an end of a second leader, and wherein the end of the probe member with the second magnet member removably positioned thereon is adapted for insertion in the second opening of the cavity; and wherein when the traveling member is positioned within the cavity, a magnetic attraction develops between the first magnet member and the magnetic bar, causing the traveling member to move toward the base assembly and become magnetically attached to the second magnet member.

2. The system as recited in claim 1, wherein the first magnet member includes a rolling mechanism, and wherein the rolling mechanism allows the traveling member to roll along the surface toward the base assembly.

3. The system as recited in claim 2, wherein the first magnet member is substantially cylindrical and is attached to the traveling member such that the first magnet member is free to rotate about an axis.

4. The system as recited in claim 3, wherein the first magnet member forms a roller of the rolling mechanism.

5. The system as recited in claim 2, wherein the first magnet member has a hollow center, and wherein the traveling member comprises a tether having a portion that passes through the hollow center of the first magnet member.

6. The system as recited in claim 5, wherein the tether further comprises an end attached to an eyelet, and wherein the eyelet is adapted for attachment to the end of the first leader.

7. The system as recited in claim 2, wherein the second magnet member has a hollow center, and wherein the base assembly comprises a tether having a portion that passes through the hollow center of the second magnet member.

8. The system as recited in claim 7, wherein the tether further comprises an end attached to an eyelet, and wherein the eyelet is adapted for attachment to the end of the second leader.

9. The system as recited in claim 1, wherein the base assembly comprises a bracket attached to the probe member, wherein the bracket is adapted for attaching the base assembly to an edge of the second opening such that the probe member remains positioned in the second opening.

10. The system as recited in claim 1, wherein the base assembly comprises an annunciator circuit adapted to produce a sound when the traveling member contacts the base assembly.

11. The system as recited in claim 10, wherein the annunciator circuit is mounted on the probe member.

12. The system as recited in claim 1, wherein the base assembly further comprises a third magnet member, and wherein the probe member is adapted to removably receive the second and third magnet members at opposite sides of the end of the probe member.

13. The system as recited in claim 12, wherein the base assembly comprises an annunciator circuit adapted to produce a sound when the traveling member contacts the base assembly, and wherein the annunciator circuit comprises a pair of electrical contacts positioned between the second and third magnet members, and wherein the pair of electrical contacts are activated when the traveling member contacts the base assembly.

* * * * *